US005974718A

United States Patent [19]

Bentley et al.

[11] Patent Number: 5,974,718

[45] Date of Patent: Nov. 2, 1999

[54] RECOIL SYSTEM FOR THE BUTT STOCK OF A FIREARM

[76] Inventors: James K Bentley, 2489 Starling Dr., Paso Robles, Calif. 93446; Willard H Crawford, 1836 Orange St., Bakersfiled, Calif. 93004

[21] Appl. No.: 09/080,163

[22] Filed: May 15, 1998

Related U.S. Application Data

[63] Continuation-in-part of application No. 08/794,760, Feb. 3, 1997, Pat. No. 5,752,339.

[51] Int. Cl.[6] ..... F41C 23/00

[52] U.S. Cl. ..... 42/74; 42/73

[58] Field of Search ..... 42/73.74, 71.01

[56] References Cited

U.S. PATENT DOCUMENTS 3,754,344 8/1973 Spiliotis ..... 42/74
4,663,877 5/1987 Bragg ..... 42/74
5,031,348 7/1991 Carey ..... 42/74
5,392,553 2/1995 Carey ..... 42/73

*Primary Examiner*—Charles T. Jordan
*Assistant Examiner*—Matthew J. Lattig
*Attorney, Agent, or Firm*—Charles C. Logan, II

[57] ABSTRACT

A recoil system for the butt stock of a firearm having a recoil suppressor assembly whose front end is mounted in the cavity in the rear end of the butt stock. The piston ram of the recoil suppressor assembly in its static position extends rearwardly into a bore hole cavity of an elongated recoil housing. When the firearm is shot, the elongated body portion of the recoil suppressor assembly and its transversely extending mounting flange portion instantaneously travel rearwardly into the bore hole cavity with the bore hole of the body housing reciprocally traveling over the piston ram. An extension coil spring whose front end is secured to the front end of the body portion and whose rear end is secured to a cam assembly returns the elongated body portion to its static position once the recoil of the firearm has been suppressed.

12 Claims, 4 Drawing Sheets

RECOIL SYSTEM FOR THE BUTT STOCK OF A FIREARM

This application is a CIP of Ser. No. 08/794,760 filed Feb. 3, 1997 now U.S. Pat. No. 5,752,339.

BACKGROUND OF THE INVENTION

The invention relates to firearms and more specifically to a recoil system for the butt stock of a firearm.

One of the age old problems that has existed with firearms is the fact many of them have a severe recoil that affects the person firing the weapon. In firearms such as shotguns and rifles, the rear end of the butt stock is positioned against the shooters shoulder and the recoil often causes the shooter to raise the front of the firearm each time the weapon is fired. Also the amount of recoil varies depending upon the amount of explosive in the shell being fired and the recoil can result in pain and or bruising to the shoulder area of the person firing the weapon. One example of the recoil being detrimental to a shooter's accuracy is when the firearm is a shotgun being used for skeet shooting by a man or a woman.

The best prior art recoil systems for the butt stock of a firearm have been very expensive and the inexpensive systems do not function properly. Two examples of expensive systems are a hydro-coil fluid dampening system and a pneumatic air chamber system. The present day inexpensive recoil systems utilize compression coil springs to absorb the recoil forces. If the compression coil spring is a little too strong, you get more recoil than with a regular firearm. If the compression coil spring is not strong enough it is worse, in that it gives the gun some travel and it is the same as holding the butt stock too loosely.

It is an object of the invention to provide a novel recoil system for the butt stock of a firearm that minimizes the amount of recoil force experienced by the person firing the weapon.

It is also an object of the invention to provide a novel recoil system for the butt stock of a firearm that minimizes pain to the shoulder of the person firing the weapon due to recoil forces.

It is another object of the invention to provide a novel recoil system for the butt stock of a firearm that requires limited modification to the butt stock.

It is a further object of the invention to provide a novel recoil system for the butt stock of a firearm that utilizes an extension coil spring for the first time.

It is also an object of the invention to provide a novel recoil system for the butt stock of a firearm that is easily mounted to the rear end of a conventional butt stock.

SUMMARY OF THE INVENTION

The recoil system for the butt stock of a firearm is installed in the rear end cavity of a conventional butt stock. The existing recoil pad is removed and set aside for later assembly. A recoil suppressor assembly is then attached to the open end of the butt stock. Attached over the rear end of the recoil suppressor assembly is a rubber recoil housing and to its rear wall is then attached the previously removed recoil pad.

The recoil suppressor assembly has an elongated body portion with a mounting flange portion extending transversely adjacent its rear wall. The rear wall of the elongated body portion has a vertically extending bore hole within which is reciprocally received a piston ram. The rear end of the piston ram extends into the bore hole cavity of the recoil housing approximately 1½ inches. The rear end of the piston ram has a pair of laterally spaced threaded bore holes that receive screws that are inserted through aligned bore holes in the rear wall of the recoil housing.

In its static position the piston ram extends from the rear end of the elongated body portion approximately 1½ inches. As the firearm is shot, the recoil transmitted through the butt stock will drive the butt stock and the elongated body portion rearwardly causing it and the transversely extending mounting flange portion to travel rearwardly in the bore hole cavity of the recoil housing. After the butt stock has reached its rearward position, the extension coil spring structure will return the elongated body portion to its initial forward static position.

The elongated extension coil spring is mounted externally of the elongated body portion. Its front end is secured to a pin or retainer secured to the front end of the elongated body portion. The rear end of the extension coil spring is connected to the front end of the front lever arm. The rear end of the front lever arm is pivotally secured to the bottom end of the rear lever arm. The rear lever arm is positioned substantially vertically in an aperture in the mounting flange portion of the body portion and it pivots about a hinge pin positioned intermediate its top and bottom ends. A roller cam is mounted on the top end of the rear lever arm and it is captured in a cavity in the bottom wall of the piston ram. When the recoil action takes place, the mounting flange portion travels rearwardly thereby causing the roller cam on the top end of the rear lever arm to travel forwardly in the cavity in the bottom wall of the piston ram. After the recoil force has been dissipated, the extension coil spring causes the rear lever arm to be pivoted clockwise so that the elongated body portion returns to its static position.

A first alternative embodiment recoil suppressor assembly has an elongated body portion with a mounting flange portion extending transversely adjacent its rear wall. The rear wall of the elongated body portion has a longitudinally extending primary bore hole within which a piston ram is reciprocally received. The rear end of the piston ram extends into the interior chamber of the tubular bellows recoil housing approximately 1½ inches. The rear end of the piston ram has a pair of vertically spaced bore holes that receive screws that are inserted through aligned bore holes in the rear wall of the tubular bellows recoil housing. The front end of the tubular bellows recoil housing is detachably secured to the open rear end of the butt stock. An elongated extension coil spring is mounted externally of the elongated body portion. The front end is secured to a transversely extending pin secured to a pair of bifurcated fingers extending downwardly from the front end of the body portion. The rear end of the spring is secured to the front end of a length of motorcycle chain and the rear end of the chain is secured to the front end of the lever of the cam assembly. The rear end of the lever has a pair of bifurcated fingers that receive a roller cam therebetween that is mounted on a transversely extending pin.

In its static position, the roller is captured in the bottom end of a cavity formed in the bottom surface of the piston ram. As the firearm is shot, the recoil transmitted through the butt stock will drive the butt stock and the elongated body portion rearwardly causing it and the transversely extending mounting flange portion to travel rearwardly in the interior chamber of the tubular bellows recoil housing. As this is happening the roller cam travels upwardly in the cavity formed in the bottom surface of the piston ram and the front end of the lever pivots downwardly and rearwardly approximately 180 degrees and into the cutout portion formed in the rear wall of the tubular bellows recoil housing. After the butt stock has reached its rearward position, the extension coil spring structure will return the elongated body portion to its initial forward static position.

A second alternative embodiment of the recoil suppressor assembly also has an elongated body portion with a mounting flange portion extending transversely adjacent its rear wall. The rear wall of the elongated body portion also has a longitudinally extending bore hole within which a piston ram is reciprocally received. The rear end of the piston ram extends in to the interior chamber of the tubular bellows recoil housing approximately 1½ inches. The rear end of the piston ram is secured to a transversely extending rear wall. Above and below the piston ram coil, spring bore holes are formed that extend from the rear end of the elongated body portion to its front end. An extension coil spring is positioned in each of these respective bore holes with their rear ends being rigidly captured by transversely extending pins in these bore holes. The front end of the springs are captured by a cylindrical arm extending transversely from the front end of the piston ram. The front end of the elongated body portion is open so that when the firearm is shot, the recoil transmitted through the butt stock will drive the butt stock and the elongated body portion rearwardly causing it and the transversely extending mounting flange portion to travel rearwardly into the interior chamber of the tubular bellows recoil housing. As this occurs, the piston ram drives the front end of the respective extension coil spring out through the open front end of the elongated body portion. After the butt stock has reached its rearward position, the extension coil spring structure will return the elongated body portion to its initial static position.

DESCRIPTION OF THE PREFERRED EMBODIMENT

The novel recoil system for the butt stock of a firearm will now be described by referring to FIGS. 1–4 of the drawings.

Figure 1:
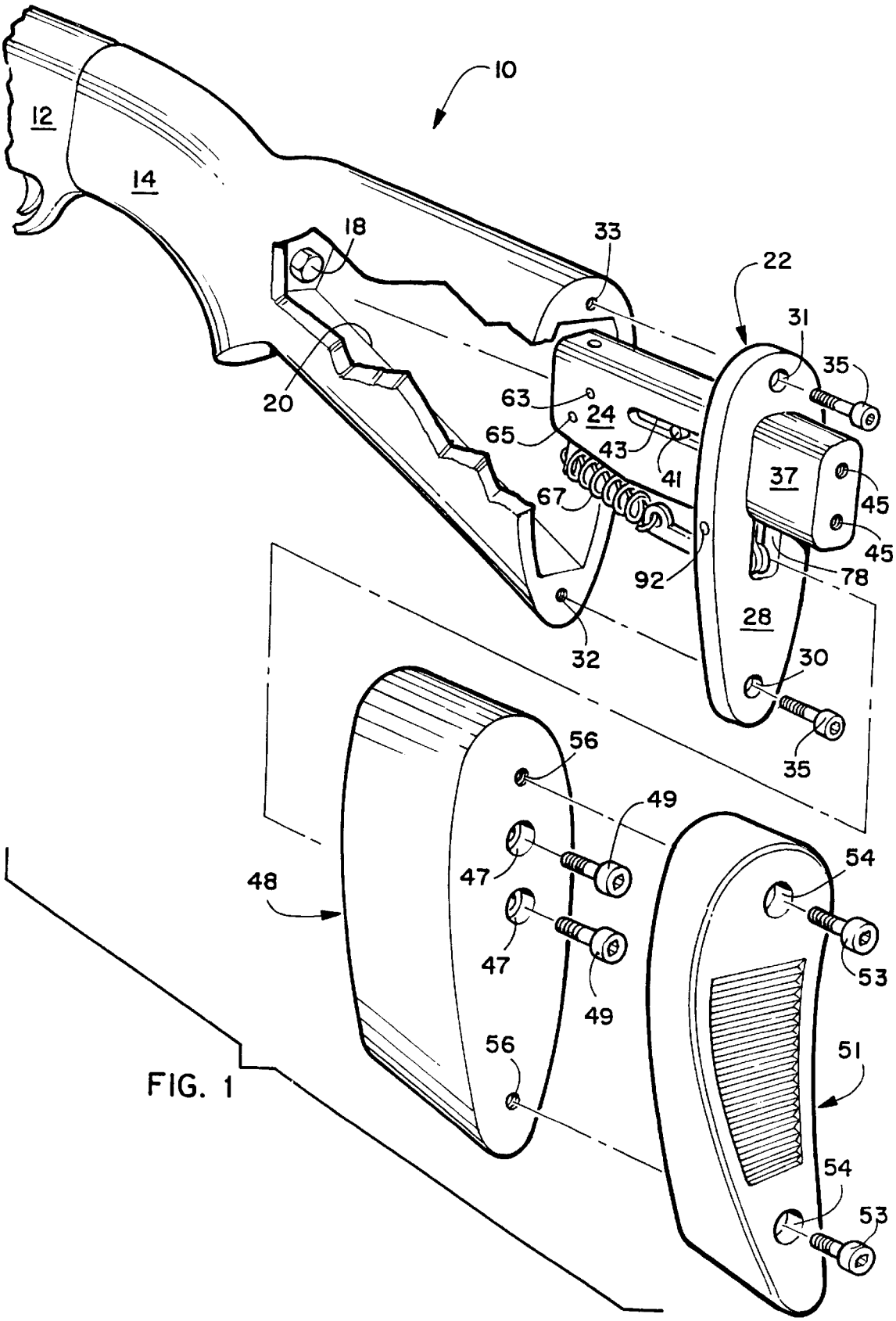
FIG. 1 is an exploded perspective view of the recoil system and the manner in which it is secured to the rear end of the butt stock of a firearm.

In FIG. 1, a firearm 10 (which is normally a shotgun or a rifle) has a receiver 12 and a conventional butt stock 14. Butt stock 14 has a bore hole 16 through which is inserted the shank of a bolt 18 whose front end is threadably secured to the rear end of receiver 12. Cavity 20 receives recoil suppressor assembly 22.

Recoil suppressor assembly 22 has an elongated body portion 24 having an X-axis. Body portion 24 has a front wall 26 and a rear wall 27. A mounting flange portion 28 extends transversely to the elongated body portion 24. A bottom bore hole 30 and a top bore hole 31 align with respective threaded bore holes 32 and 33 in the rear end of butt stock 14 and a pair of screws 35 detachably secure the mounting flange portion 28 to butt stock 14.

A piston ram 37 extends rearwardly from rear wall 27 a predetermined distance D1 which is approximately 1½ inches. The front end of piston ram 37 is reciprocally received in bore hole 39 of body portion 24. There is a transversely extending bore hole 41 in piston ram 37 and a pin 42 is inserted therein and its outer end is captured in a slot 43 in the side wall of body portion 24 thereby allowing the piston ram 37 to travel reciprocally forward and backward in bore hole 39. The rear wall of piston ram 37 has a pair of threaded bores 45 that align with bore holes 47 in recoil housing 48 and screws 49 secure the two members together. Recoil pad 51 which originally had been removed from the rear of butt stock 14 is then secured by screws 53 passing through bore holes 54 in recoil pad 51 and then threadably received in threaded bore holes 56 in recoil housing 48.

The front end of body portion 24 has a slot 58 for receiving a reversible retainer 60. Reversible retainer 60 has a pair of vertically spaced pin apertures 62 for removably receiving connecting pins 63. By reversing the orientation of reversible retainer 60, either a short spring or a long spring may be utilized depending upon the need for shells having either high or low base powder charges. This provides approximately 1½ inch adjustment for spring changes. Connecting pins 63 would also pass through aligned respective apertures 65 in the opposite side walls of body portion 24.

A extension coil spring 67 has its front end inserted into aperture 68 at the bottom end of reversible retainer 60. A cam assembly 70 has a front lever arm 72 and a rear lever arm 73 that are pivoted together by a pin 74. Lever arm 72 has an aperture 76 formed in its front end for receiving the rear end of extension coil spring 67. Rear lever arm 73 in its static position normally has its bottom end received within aperture 78 in rear wall 28 and its top end received in cavity 80 in the bottom wall of piston ram 37. A roller cam 82 is mounted on a pin 83 passing through the top end of rear lever arm 73.

Figure 2:
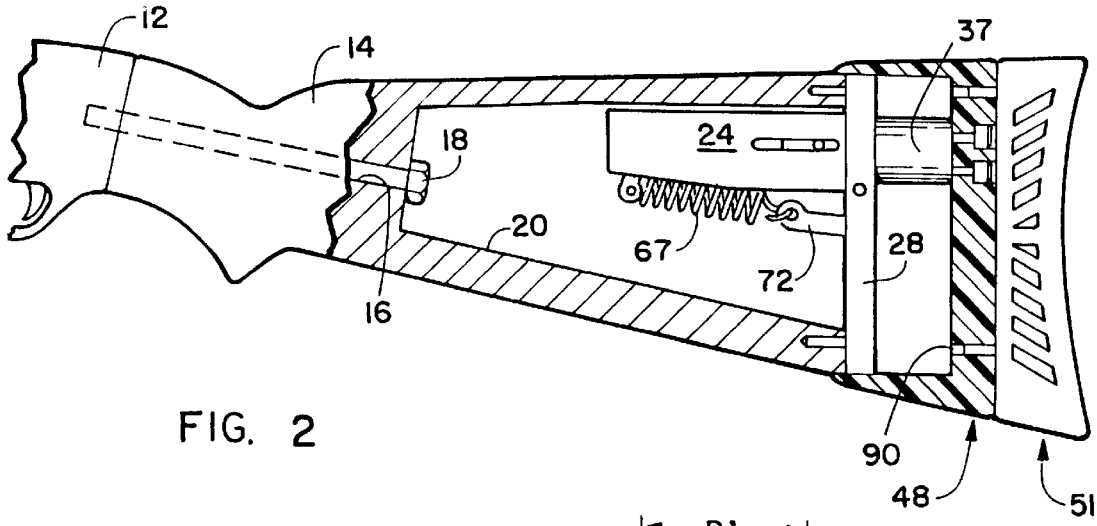
FIG. 2 is a side elevation view with portions shown in cross-section illustrating the recoil suppressor assembly secured to the rear end of the butt stock of the firearm.
Figure 3:
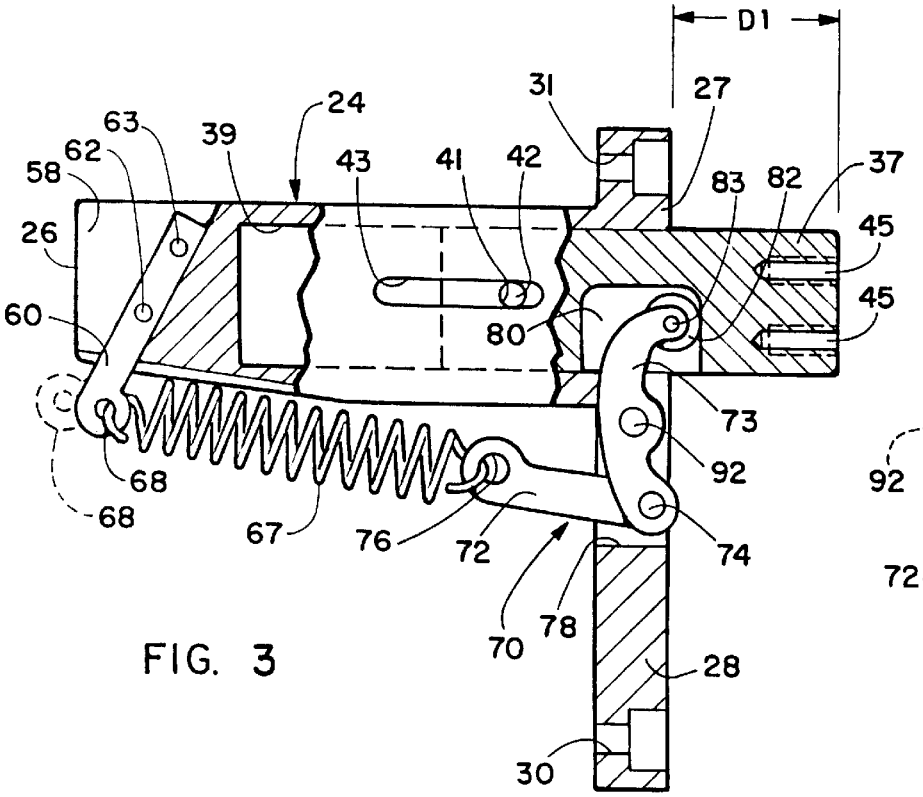
FIG. 3 is an enlarged side elevation cross-sectional view of the recoil suppressor assembly.
Figure 4:
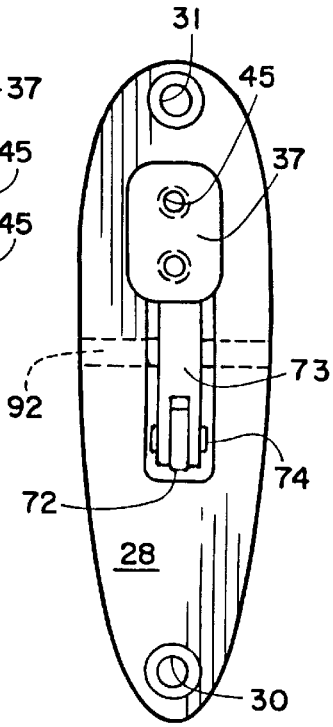
FIG. 4 is a rear elevation view of the recoil suppressor assembly.

The manner in which the novel recoil system functions starts with the piston ram in its static position illustrated in FIG. 2. When the weapon is fired, the recoil of the butt stock causes it to travel rearward until the rear wall of mounting flange portion 28 has reached the front surface of the bore hole cavity 90 in recoil housing 48. As this is occurring, elongated body portion 24 has also traveled rearwardly so that the front end of piston ram 37 approaches the front end of bore hole 39. Rear lever arm 73 at the same time is pivoting around hinge pin 92 and roller cam 82 is traveling the inner surface of cavity 80. Once the recoil force has been dampened or eliminated, extension coil spring 67 pulls front lever arm 72 forward and causes rear lever arm 73 to rotate clockwise back to its original static position.

Figure 5:
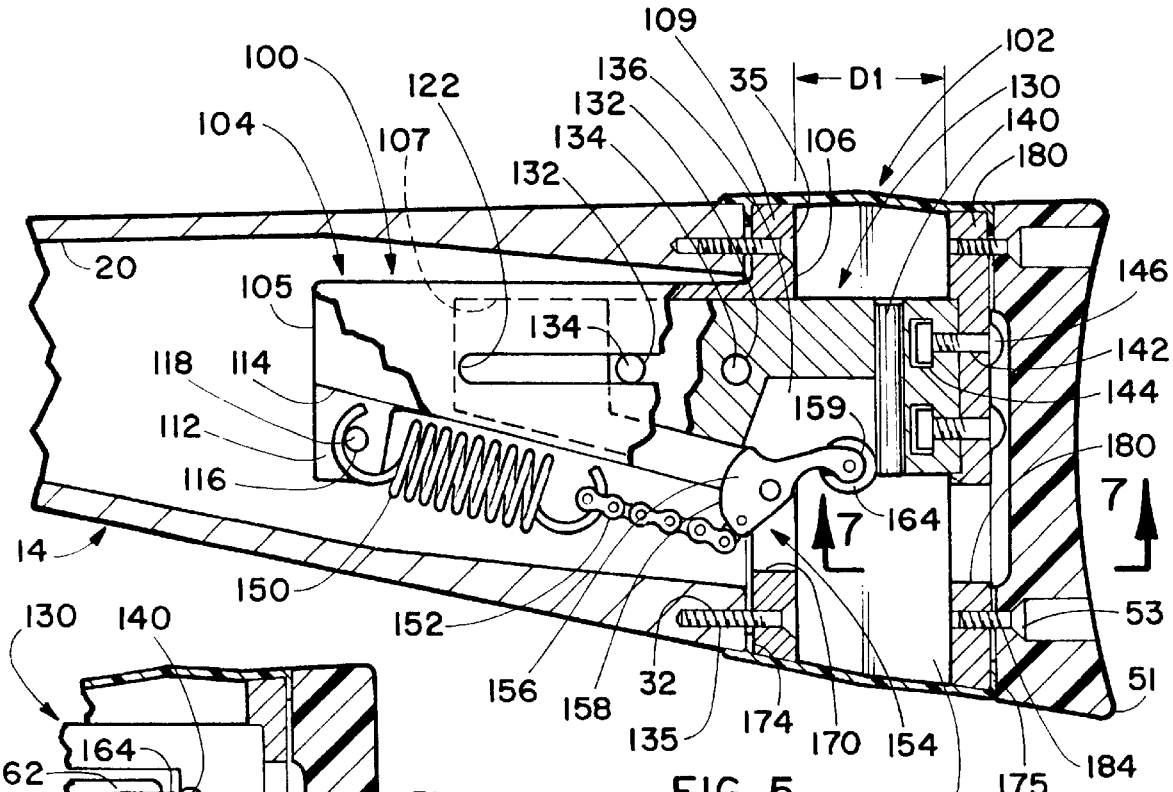
FIG. 5 is a side elevation view with portions shown in cross-section illustrating the first alternative embodiment of the recoil suppressor assembly secured to the rear end of the butt stock of the firearm when the recoil suppressor assembly is in its static position.
Figure 7:
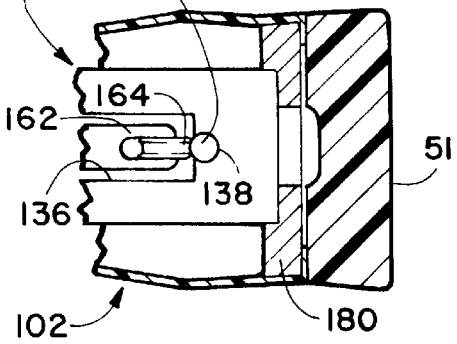
FIG. 7 is a cross-sectional view taken along lines 7—7 of FIG. 5.
Figure 6:
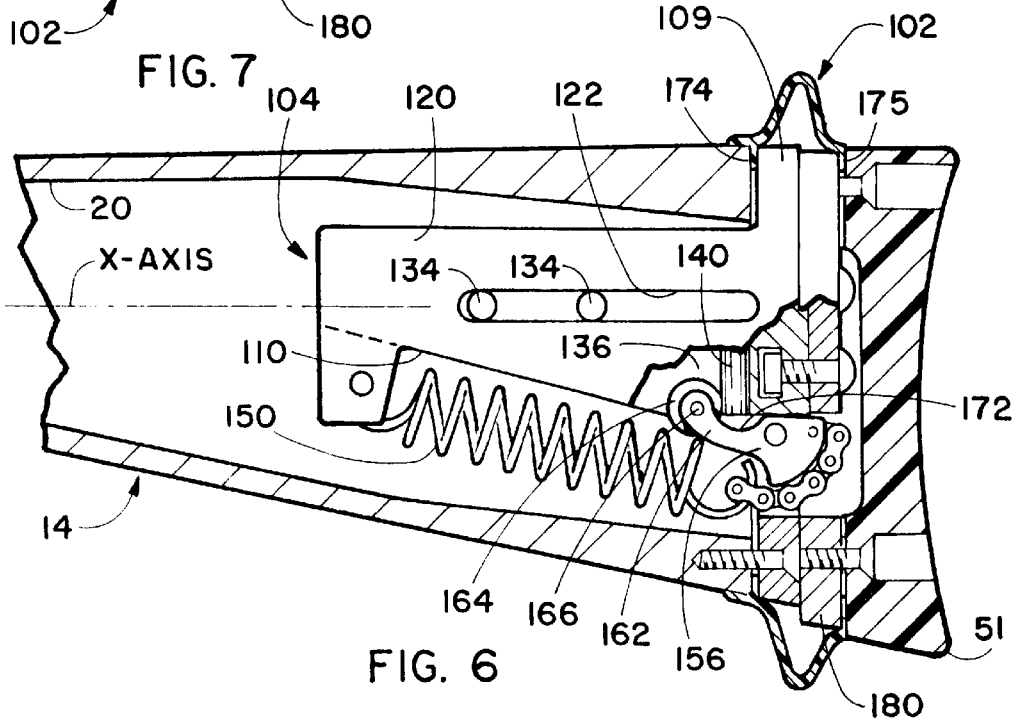
FIG. 6 is a side elevation view of the second alternative embodiment of the recoil suppressor assembly illustrated in FIG. 5 showing it now in its dynamic compressed position.

The first alternative embodiment is illustrated in FIGS. 5–7. The structure of the butt stock and the recoil pad are identified by the same numerals as utilized in the embodiment illustrated in FIGS. 1–4. This embodiment has a recoil suppressor assembly 100 and a tubular bellows housing 102.

Recoil suppressor assembly 100 has an elongated body portion 104 having a front wall 105, a rear wall 106, a primary bore hole 107, a mounting flange 109 and a bottom wall 110. Laterally spaced bifurcated fingers 112 extend downwardly from the front end of body portion 104 and form a slot or channel 114 therebetween. Each of the bifurcated fingers 112 has a bore hole 116 that receives the respective opposite ends of a pin 118. The laterally spaced vertical left and right side walls 120 of body portion 104 have an elongated slot 122 in them. The function of elongated slots 122 will be described later.

A piston ram 130 is telescopically received in primary bore hole 107 of elongated body portion 104. It has a pair of longitudinally spaced transversely extending bore holes 132 passing between its vertical side walls and pins 134 extend outwardly on both sides and are captured in the respective slots 122 of the respective side walls 120. This structure provides a guide for the travel of the piston ram 130 forwardly and rearwardly in body portion 104. A cavity 136 is formed in the bottom wall of piston ram 130 and adjacent its rear end is a vertical bore hole 138 having a pin 140 inserted therein and it performs a function to be described later. A pair of vertically spaced bore holes 142 are formed in the rear end of piston ram 130 and they each have a cavity 144 for receiving nuts to be threaded on screws 146.

An extension coil spring 150 has its front end captured by pin 118 and its rear end is captured in the front end of a length of motorcycle chain 152. The rear end of chain 152 is secured to cam assembly 154. Cam assembly 154 has a lever 156 having a front end 158 and a rear end 159. Lever 156 has a pair of bifurcated arms 162 between which is positioned a roller cam 164 that is mounted on a pin 166. Lever 156 is positioned in an aperture 170 in rear wall 106 of body portion 104. FIGS. 5 and 6 show the respective positions of lever 156 when butt stock 14 is at both its forward and rearward positions. Roller cam 164 is captured in cavity 136(see FIG. 7) and as the rear end of butt stock 14 travels rearwardly, roller cam 164 travels upwardly along the surface of metal pin 140. Lever 156 has a curved edge 172 that travels around the bottom end of pin 140 as lever 156 travels rearwardly to the position illustrated in FIG. 6. Extension coil spring 150 returns lever 156 to the position illustrated in FIG. 5 after the recoil forces have been absorbed.

Tubular bellows recoil housing 102 has an inwardly extending front flange or lip 174 and an inwardly extending rear flange or lip 175. Lip 174 is captured between the rear end of butt stock 14 and the front end of mounting flange 109 of body portion 104 and held in position by screws 35. Bellows recoil housing 102 has an interior chamber 178 and a rear wall 180. Aligned bore holes 142 receive the respective screws 146 to secure piston ram thereto. Bore holes 184 receive screws 53 to secure recoil pad thereto.

Figure 8:
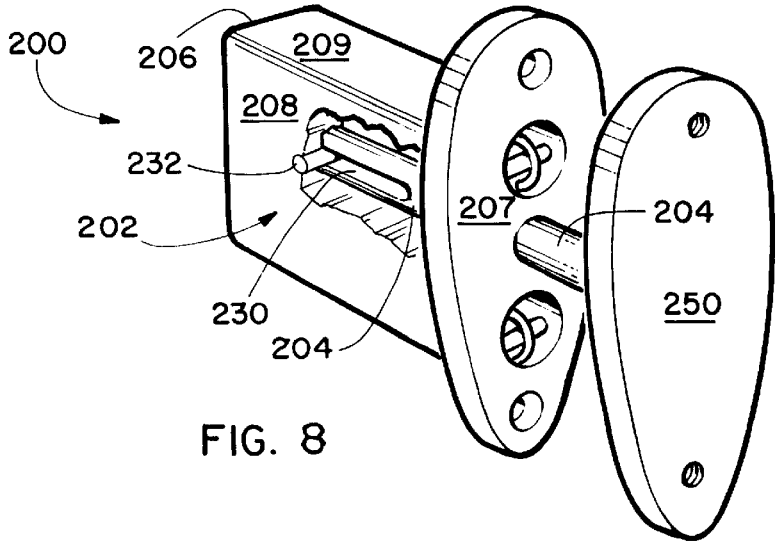
FIG. 8 is a rear perspective view of the second alternative embodiment of a recoil suppressor assembly.
Figure 9:
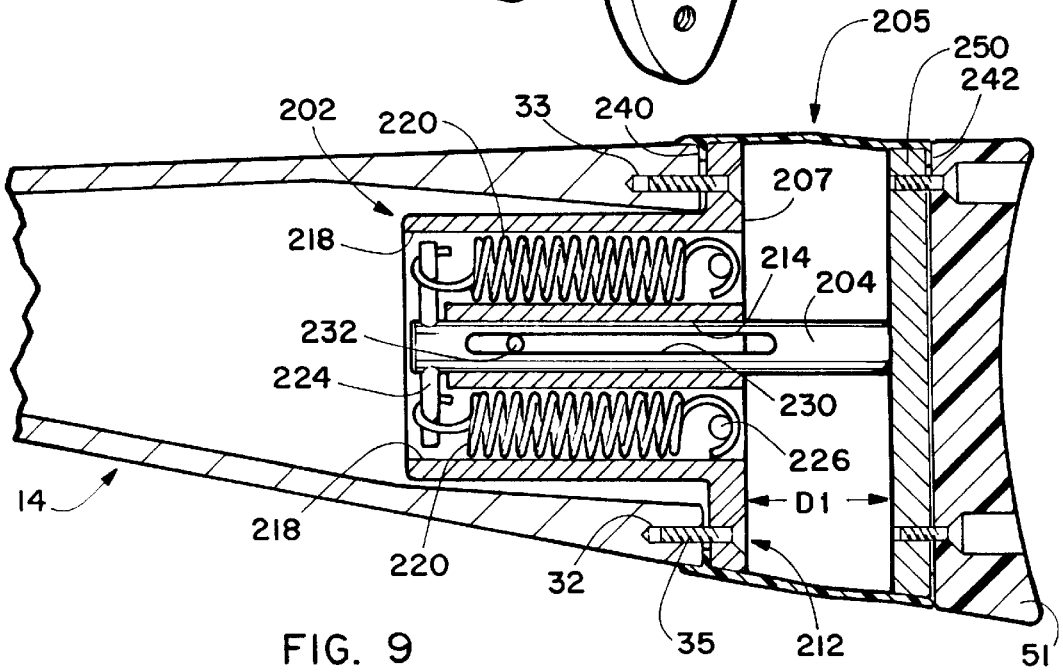
FIG. 9 is a side elevation view with portions shown in cross-section showing the second alternative embodiment recoil suppressor assembly in its static position.
Figure 10:
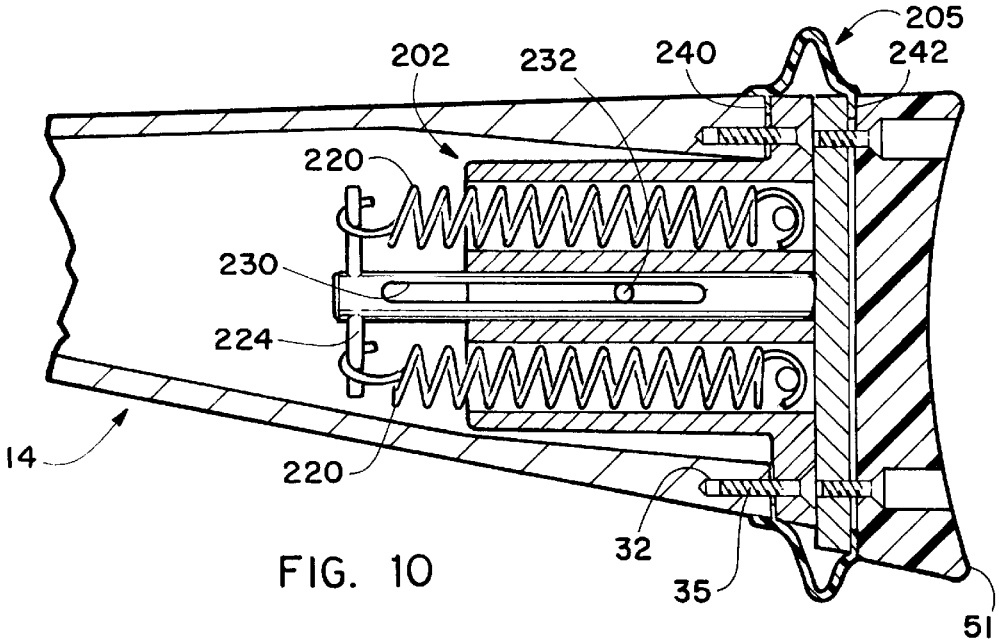
FIG. 10 is a side elevation view with portions shown in cross-section of the second alternative embodiment recoil suppressor assembly showing it in its dynamic compressed position.

A second alternative embodiment is illustrated in FIGS. 8–10. It has a recoil suppressor assembly 200 having an elongated body portion 202, a piston ram 204, and a tubular bellows recoil housing 205.

Body portion 202 has a front end 206, a rear end 207, a left side wall 208 and a right side wall 209. A mounting flange 212 extends from rear end 207. A primary bore hole 214 extends the length of body portion 202 and it telescopically receives a piston ram 204. A pair of coil spring bore holes 218 receive extension coil springs 220. A cylindrical arm 224 passes transversely through the front end of piston ram 204 and it captures the front end of the respective extension coil springs 220. The rear end of these springs are captured by pins 226. Piston ram 204 has an elongated slot 230 that captures a pin 232 passing through between the side walls 208 and 209. Slot 230 acts as a guide or track.

Tubular bellows housing 205 has inwardly extending flanges or lips 240 at its front end and inwardly extending flanges or lips 242 at its rear end. A plate or wall 250 may be secured to the rear end of piston ram 204. Screws 35 capture lips 240 between the rear end of butt stock 14 and the front end of mounting flange 212. Screws 53 capture lip 242 between the rear end of wall 250 and the front end of recoil pad 51.

What is claimed is:

1. A recoil system for the butt stock of a firearm comprising:

a recoil suppressor assembly having an elongated body portion having a longitudinally extending X-axis; said body portion having a front end, a rear end and a rear wall; a primary bore hole is formed in said rear wall and it extends forwardly a predetermined distance along said X-axis; said primary bore hole having a predetermined cross-sectional configuration; an elongated piston ram reciprocally mounted in said primary bore hole and it has a cross-sectional configuration that mates with the shape of said primary bore hole; said piston ram having a front end, a rear end and a bottom wall; wherein when the piston ram is in a static position, the rear end of the piston ram extends a predetermined distance from the rear end of said body portion;

means for removably securing said recoil suppressor assembly to the rear end of a conventional butt stock of a firearm;

an elongated tubular bellows recoil housing having an open front end, a rear end, a rear wall and an interior chamber; said interior chamber configured to momentarily receive a rear end of a firearm butt stock as it travels rearwardly once a firearm has been fired; and means for securing said tubular bellows recoil housing to said rear end of said recoil suppressor assembly.

2. A recoil system for the butt stock of a firearm as recited in claim 1 further comprising a conventional recoil pad and means for detachably securing it to the rear end of said tubular bellows recoil housing.

3. A recoil system for the butt stock of a firearm as recited in claim 1 wherein said means for securing said tubular bellows recoil housing to said rear end of said recoil suppressor assembly comprises at least one bore hole in the rear end of said piston ram and it is aligned with a bore hole that extends through said rear wall of said tubular bellows recoil housing and a screw inserted therethrough is removably secured in said bore hole of said piston ram.

4. A recoil system for the butt stock of a firearm as recited in claim 1 further comprising an elongated extension coil spring having a front end and a rear end and said extension coil spring is positioned externally of said body portion; said front end of said extension coil spring being detachably secured to the front end of said body portion; a cam assembly having an elongated lever having a front end and a rear end; a roller is pivotally secured to the rear end of said lever; said bottom wall of said piston ram having a cavity formed therein adjacent said rear end of said piston ram, said roller on said front end of said lever removably captured in said cavity in said bottom wall of said piston ram; an elongated chain having a front end and a rear end, said rear end of said chain being secured to said front end of said lever and said front end of said chain being detachably secured to said rear end of said extension coil spring.

5. A recoil system for the butt stock of a firearm as recited in claim 4 wherein said elongated body portion has a transversely extending mounting flange portion and it has an aperture for receiving said lever arm; said lever arm being pivotally moveable in and out through said aperture of said mounting flange portion.

6. A recoil system for the butt stock of a firearm as recited in claim 1 further comprising means for detachably securing said piston ram in said body portion.

7. A recoil system for the butt stock of a firearm comprising:

a recoil suppressor assembly having an elongated body portion having a longitudinally extending X-axis; said body portion having a front end, a rear end and a rear wall; a primary bore hole is formed in said rear wall and it extends forwardly to said front end; said primary bore hole having a predetermined cross-sectional configuration; an elongated piston ram reciprocally mounted in said primary bore hole and it has a cross-sectional configuration that mates with the shape of said primary bore hole; said piston ram having a front end and a rear end; wherein when the piston ram is in a static position, the rear end of the piston ram extends a predetermined distance from the rear end of said body portion;

means for removably securing said recoil suppressor assembly to the rear end of a conventional butt stock of a firearm;

an elongated tubular bellows recoil housing having an open front end, a rear end, a rear wall and an interior chamber; said interior chamber configured to momentarily receive a rear end of a firearm butt stock as it travels rearwardly once a firearm has been fired; and means for securing said tubular bellows recoil housing to said rear end of said recoil suppressor assembly.

8. A recoil system for the butt stock of a firearm as recited in claim 7 further comprising a conventional recoil pad and means for detachably securing it to the rear end of said tubular bellows recoil housing.

9. A recoil system for the butt stock of a firearm as recited in claim 7 further comprising means for securing said tubular bellows recoil housing to the rear end of said piston ram.

10. A recoil system for the butt stock of a firearm as recited in claim 9 wherein said means for securing said tubular bellows recoil housing to the rear end of said piston ram comprises a transversely extending plate secured to said rear end of said piston ram; said plate having a rear end and said rear end of said tubular bellows recoil housing being removably secured to said rear end of said plate.

11. A recoil system for the butt stock of a firearm as recited in claim 7 further comprising at least one coil spring bore hole extending through said elongated body portion from said front end to said rear end; at least one elongated extension coil spring having a front end and a rear end and said coil spring is positioned in said coil spring bore hole; a transversely extending pin is rigidly secured in said coil spring bore adjacent said rear end of said coil spring bore hole and said rear end of said elongated extension coil spring is secured to said pin; an arm extends transversely to said piston ram adjacent said front end of said piston ram and said front end of said extension coil spring is secured to said arm.

12. A recoil system for the butt stock of a firearm as recited in claim 7 wherein said means for removably securing said recoil suppressor assembly to the rear end of said conventional butt stock of a firearm comprises a transversely extending mounting flange on said rear end of said elongated body portion.

* * * * *